US005193675A

United States Patent [19]

Otis

[11] Patent Number: 5,193,675

[45] Date of Patent: Mar. 16, 1993

[54] BABY MERCHANDISE DISPLAY PACKAGE

[75] Inventor: Jon D. Otis, Long Branch, N.J.

[73] Assignee: E.S. Originals, Inc., New York, N.Y.

[21] Appl. No.: 883,947

[22] Filed: May 15, 1992

[51] Int. Cl.[5] ..... B65D 85/18; B65D 5/50

[52] U.S. Cl. ..... 206/278; 190/16; 206/45.11; 206/45.19; 206/45.33; 206/232; 211/34; 220/528

[58] Field of Search ..... 206/278, 45.11, 45.19, 206/45.14, 45.33, 232; 190/16; 211/34, 37, 38; 220/505, 507, 528

[56] References Cited

U.S. PATENT DOCUMENTS

| | | | |
|---|---|---|---|
| D. 124,159 | 12/1940 | Stoner | 206/45.19 X |
| 183,530 | 10/1876 | Birge | 206/45.19 |
| 1,700,432 | 1/1929 | Cahill | 206/278 X |
| 1,764,216 | 6/1930 | Laubenheimer | 206/45.19 X |
| 1,921,110 | 8/1933 | Wheary | 206/278 X |
| 2,333,643 | 11/1943 | Donellan | 206/278 X |
| 2,698,689 | 1/1955 | Novack | 211/34 |
| 3,001,650 | 9/1961 | Turner | 211/34 |
| 3,414,093 | 12/1968 | Chostner | 190/16 |
| 4,819,795 | 4/1989 | Swaney | 206/278 |
| 5,096,056 | 3/1992 | Garcia | 206/45.11 |

*Primary Examiner*—Bryon P. Gehman

*Attorney, Agent, or Firm*—Kirschstein, Ottinger, Israel & Schiffmiller

[57] ABSTRACT

A baby merchandise gift package includes three inclined racks on which respective pairs of baby shoes are mounted. A raised shelf supports a toy rattle.

9 Claims, 2 Drawing Sheets

BABY MERCHANDISE DISPLAY PACKAGE

BACKGROUND OF THE INVENTION

1. Field of the Invention

This invention generally relates to a baby merchandise package for shipment to, display at, and carrying from, a retail outlet and, more particularly, to a gift package containing a toy and multiple pairs and styles of baby shoes.

2. Description of Related Art

Baby shoes are conventionally sold in boxes commensurate to their size, one pair and style of baby shoes per box. The boxes are typically constituted of lightweight, transparent plastic to enhance visibility and impulse buying.

Although generally satsifactory for their intended purpose of holding baby shoes, the known plastic boxes are not altogether suitable to endure rigorous handling encountered during transport, at least not without being packed in larger shipping cartons. Also, strictly from the viewpoint of giving a generous baby present, the gift of a single pair of baby shoes may not be perceived as being overly magnanimous.

It is known in the art of displaying and selling shoes, as exemplified in U.S. Pat. Nos. 2,698,689; 3,001,650 and 3,414,093, for salespersons to call on customers with a handled, oversized carrying case full of shoes. However, such known cases are not shipping boxes or gift boxes and are not intended for retail store display or for displaying baby shoes.

SUMMARY OF THE INVENTION

1. Objects of the Invention

It is a general object of this invention to provide a novel baby merchandise gift package containing multiple pairs and styles of baby shoes.

It is another object of this invention to provide a gift package with the added value of a toy.

It is a further object of this invention to provide a durable package able to endure rigorous handling during transport to and from a retail outlet.

Another object of this invention is to provide a package in which baby merchandise is prominently displayed.

2. Features of the Invention

In keeping with these objects, and others which will become apparent hereinafter, one feature of this invention resides, briefly stated, in a baby merchandise package for shipment to, display at, and carrying from, a retail outlet.

The package includes a shoe box having a bottom wall, a pair of end walls spaced apart along a longitudinal direction, a pair of side walls spaced apart along a transverse direction perpendicular to the longitudinal direction, and a lift-off lid overlying and spaced from the bottom wall.

The package further includes a display insert mounted within the box. The insert includes a base resting on the bottom wall of the box, and a plurality of racks extending in mutual parallelism from one of the side walls along the transverse direction to, but terminating short of, the other of the side walls. Each rack has a support wall inclined relative to the base. The insert further includes a raised shelf extending along the longitudinal direction and elevated above the base. The shelf is located between the racks and said other side wall of the box.

The package further includes a plurality of pairs of baby shoes, preferably in different styles, e.g. dress shoes, sneakers and slippers. Each pair rests on an inclined support wall of a respective rack.

The package still further includes a baby article resting on the shelf. Advantageously, the article is a toy rattle.

In a preferred embodiment, the shoes are held in position on a respective rack by providing adhesive strips between the soles of the shoes and the support walls of the racks. The article is held in position by forming an opening in the shelf. A portion of the article is frictionally received in the opening.

A transparent protective sleeve surrounds the insert, the pairs of shoes and the article. The sleeve confines and protects the merchandise within the package while permitting viewing of same.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
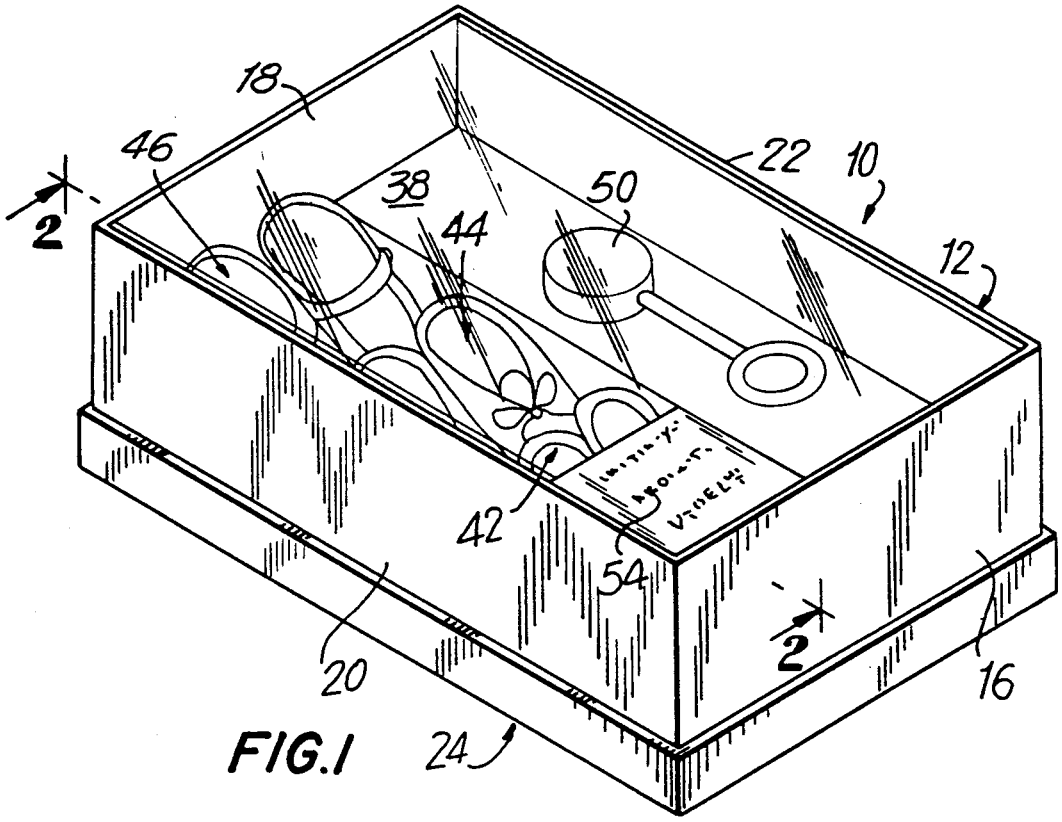
FIG. 1 is a perspective view on a reduced scale of a baby merchandise package during display according to this invention.

Referring now to the drawings, reference numeral 10 generally identifies a baby merchandise package for shipment to, display at and carrying from, a retail outlet. Package 10 comprises a generally rectangular parallelepiped shoe box 12 having a generally planar bottom wall 14, a pair of generally planar end walls 16, 18 spaced apart along a longitudinal direction and extending upwardly from the bottom wall 14, and a pair of generally planar side walls 20, 22 spaced apart along a transverse direction perpendicular to the longitudinal direction and also extending upwardly from bottom wall 14. Box 12 has an open top which is closed during transport to and from the retail outlet by overlying a lift-off lid 24 on the open top. During display, as shown throughout the drawings, lid 24 is positioned under the bottom wall 14, thereby enabling a consumer to see through the open top of the box, and being within easy reach. Lid 24 has a peripheral flange 26 which closely surrounds the border of the bottom wall 14, and which frictionally engages lower marginal regions of the end and side walls of the box.

Figure 2:
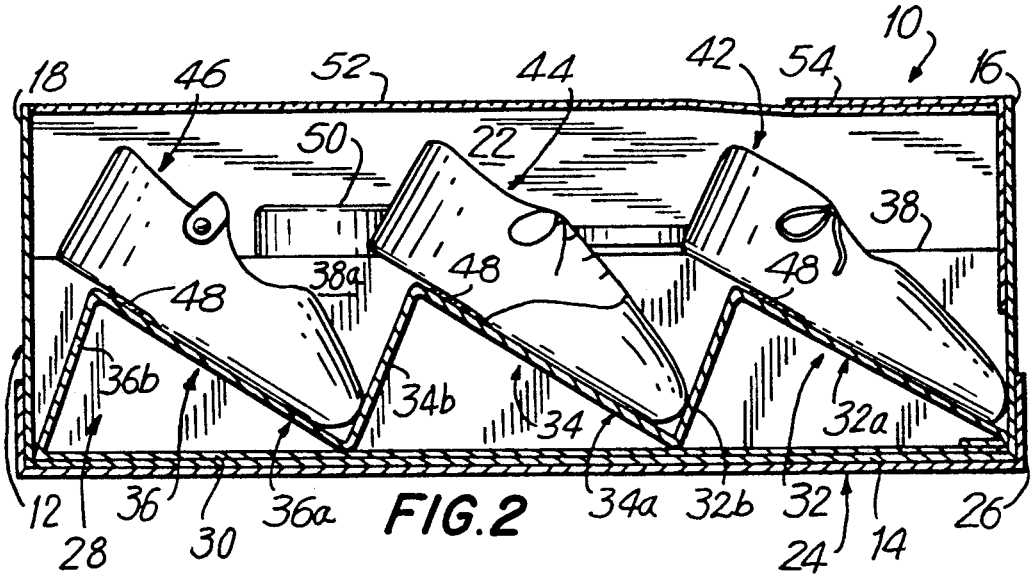
FIG. 2 is a sectional view taken along line 2—2 of FIG. 1.
Figure 3:
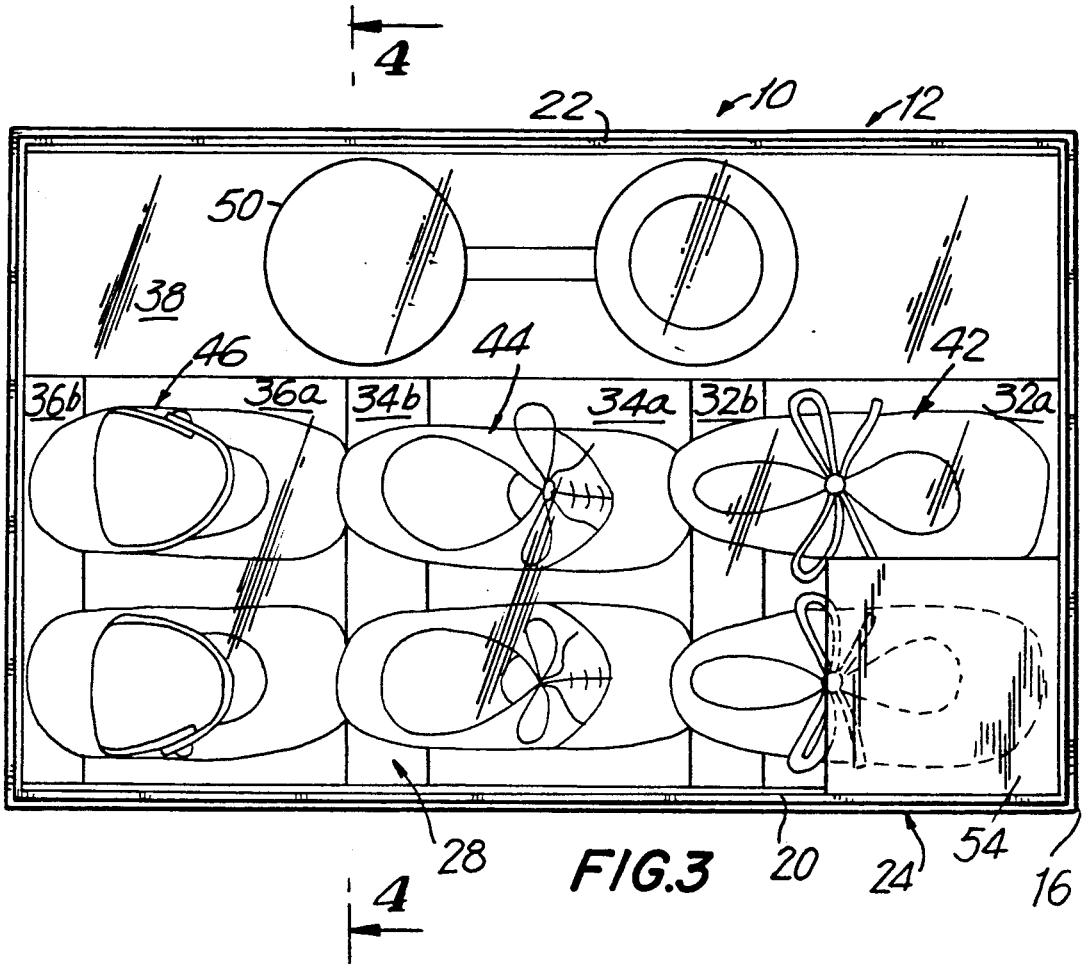
FIG. 3 is a sectional view taken along line 3—3 of FIG. 2.

Package 10 further includes a display insert 28 mounted within the box 12. The insert includes a generally planar base 30 resting on the bottom wall 14. A plurality, preferably three in number, of open racks 32, 34, 36 integral with the base 30 extend in mutual parallelism from one of the side walls, e.g. 20, along the transverse direction to, but terminating short of, the other of the side walls, i.e. 22. Each rack 32, 34, 36 has an inclined support wall 32*a*, 34*a*, 36*a* sloped relative to the base 30, and a vertically upright riser wall 32*b*, 34*b*, 36*b*. As best shown in FIG. 2, the angle of inclination of each support wall is about 45° relative to the generally horizontal plane of the base 30. All of the racks are successively arranged one behind another in stepped fashion along the longitudinal direction.

Figure 4:
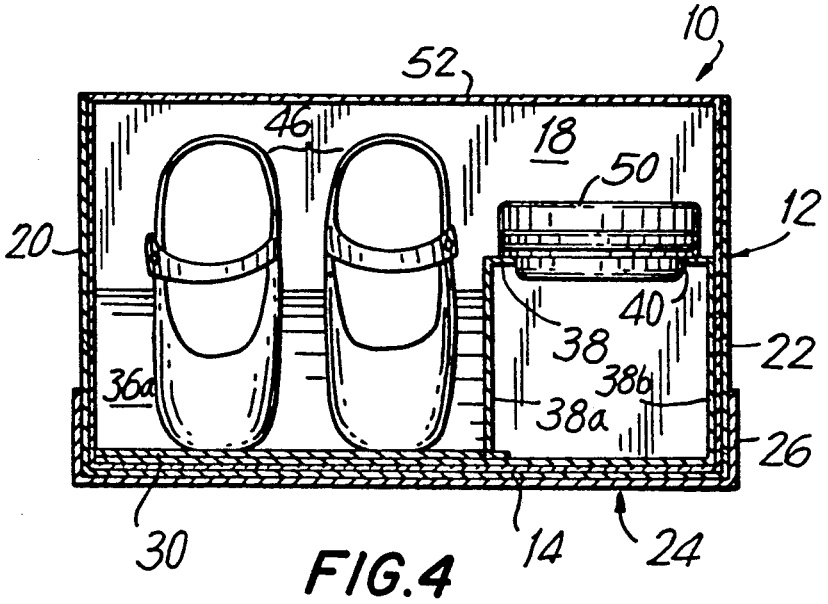
FIG. 4 is a sectional view taken along line 4—4 of FIG. 3.

Package 10 further comprises a raised shelf 38 extending along the longitudinal direction and elevated by shelf supports 38*a*, 38*b* (see FIG. 4) above the base 30. Shelf 38 is located between the racks 32, 34, 36 and the other side wall 22 of the box. Shelf 38 has an opening 40, preferably circular, formed therethrough. Shelf 38 is also of a one-piece construction with the insert 28.

The package further comprises a plurality of pairs of baby shoes 42, 44, 46 respectively resting on the inclined support walls 32*a*, 34*a*, 36*a*. Each pair represents a different style, e.g. slippers, sneakers and dress shoes. Each pair is pitched forward, with respective heel regions elevated above respective toe regions to more prominently display the shoes. To facilitate holding the shoes in such forwardly pitched orientation, adhesive strips 48 are provided between the soles of each pair of shoes and the inclined support walls of the racks. At opposite lateral sides of the shoes, the shoes are closely confined between side wall 20 of the box and shelf support 38*a*.

Package 10 still further includes a baby article, e.g. a toy rattle 50, resting on the shelf 38. Rattle 50 has a circular rattle portion which is frictionally received in circular opening 40, thereby holding the rattle firmly in position. Other baby articles, e.g. a bottle, pacifiers, bibs, teething rings, etc., are also contemplated.

The package still further comprises a transparent protective sleeve 52 surrounding the insert, all the pairs of shoes and the article. Sleeve 52 has generally planar top, bottom and side walls, each constituted of synthetic plastic material. Sleeve 52 permits viewing of the baby merchandise, but prevents touching and handling and possible soiling thereof. After purchase, the sleeve 52 may be easily removed from the insert.

The insert itself is preferably constituted of a single folded piece of heavy-duty paperboard or cardboard, although other materials are contemplated. The same or different materials can be used for the box. A gift card 54 is foldably mounted on the box, preferably by having a lower portion of the card adhered to an inner surface of end wall 16. Gift card 54 provides a convenient writing surface for a purchaser to personalize the gift.

Box 12 measures about 27 cm by about 16.5 cm and can easily accommodate three pairs of baby shoes on three open racks together with sufficient room for a toy rattle.

It will be understood that each of the elements described above, or two or more together, also may find a useful application in other types of constructions differing from the types described above.

While the invention has been illustrated and described as embodied in a baby merchandise package, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A baby merchandise package for shipment to, display at, and carrying from, a retail outlet, said package comprising:

(a) a shoe box having a bottom wall, a pair of end walls spaced apart along a longitudinal direction, a pair of side walls spaced apart along a transverse direction perpendicular to the longitudinal direction, and a lift-off lid overlying and spaced from the bottom wall;

(b) a display insert mounted within the box, including (i) a base resting on the bottom wall, (ii) a plurality of racks extending parallel to one another from one of the side walls along the transverse direction to, but terminating short of, the other side wall, each rack having a support wall inclined relative to the base, and (iii) a raised shelf extending along the longitudinal direction and located between the racks and said other side wall of the box, said shelf being elevated above the base;

(c) a plurality of pairs of baby shoes, each pair resting on the inclined support wall of a respective rack; and (d) a baby article resting on the shelf.

2. The package according to claim 1; and further comprising a transparent protective sleeve surrounding the insert, the pairs of shoes and the article.

3. The package according to claim 1; and further comprising an adhesive strip between each shoe and the support wall on which it rests to hold the shoes in position.

4. The package according to claim 1, wherein the shelf has an opening into which a portion of the article is received to hold the article in position on the shelf.

5. The package according to claim 4, wherein the article is a toy rattle.

6. The package according to claim 1, wherein the insert is constituted of a single folded piece of heavy-duty paperboard.

7. The package according to claim 1, wherein the box measures about 27 cm by about 16.5 cm and respectively accommodates three pairs of baby shoes on three racks.

8. The package according to claim 1, wherein each pair of baby shoes is a different shoe style.

9. The package according to claim 1; and further comprising a gift card foldably mounted on the box.

* * * * *